US007246473B2

(12) United States Patent
Lau et al.

(10) Patent No.: US 7,246,473 B2
(45) Date of Patent: Jul. 24, 2007

(54) ANCHORAGE SYSTEM FOR STRUCTURAL REINFORCEMENT OF FIBER REINFORCED PLASTIC MATERIALS AND THE LIKE

(76) Inventors: David T. Lau, 2-1121 Bavlie Ave., Ottawa, Ontario (CA) K1H 8P3; Nicolas Londono, 18 Glen Ave., Apt. 3, Ottawa, Ontario (CA) K1S 2Z7; Stylianos Hiotakis, 95 James St., Ottawa, Ontario (CA) K1R 5M2

( * ) Notice: Subject to any disclaimer, the term of this patent is extended or adjusted under 35 U.S.C. 154(b) by 520 days.

(21) Appl. No.: 10/819,854

(22) Filed: Apr. 7, 2004

(65) Prior Publication Data

US 2005/0252142 A1 Nov. 17, 2005

(51) Int. Cl.

| | |
|---|---|
| ***E04B 2/00*** | (2006.01) |
| ***E04B 5/00*** | (2006.01) |
| ***E04B 9/00*** | (2006.01) |
| ***E04B 1/38*** | (2006.01) |
| ***E04C 5/00*** | (2006.01) |

(52) U.S. Cl. ..... 52/506.05; 52/698; 156/71

(58) Field of Classification Search ..... 52/573.1, 52/746.1, 698, 514, 287.1, 506.01, 506.05, 52/512, 716.2, 245, 247, 273; 248/220.1; 24/304; 156/71, 91, 92, 94, 98; 16/16, 7, 16/12

See application file for complete search history.

(56) References Cited

U.S. PATENT DOCUMENTS

| | | | | |
|---|---|---|---|---|
| 1,026,406 | A * | 5/1912 | Nichols | 52/287.1 |
| 1,350,349 | A * | 8/1920 | Adolph | 52/402 |
| 1,418,133 | A * | 5/1922 | Diehl | 16/12 |
| 6,003,276 | A * | 12/1999 | Hegemier et al. | 52/273 |

* cited by examiner

*Primary Examiner*—Robert Canfield
*Assistant Examiner*—Hunter M Dreidame
(74) *Attorney, Agent, or Firm*—Frommer Lawrence & Haug LLP; Ronald R. Santucci

(57) ABSTRACT

An anchorage system for structural reinforcement of surface bonded reinforcing sheet, plate or shell made of fiber reinforced plastic (FRP) or steel or other metallic or non-metallic materials is disclosed. The anchorage system comprises an anchor tube or solid rod with a circular outer surface and a lock-down means provided along the longitudinal axis of the tube or rod. The lock-down means can be either an anchor bolt mounted through the center of the anchor tube or rod or an anchor strap pressed against the circular surface of the tube or rod into the members to be reinforced. The FRP reinforcing sheet, plate or shell is bonded to the surface of the structural member, and optionally, the supporting member, and passes underneath the outer circular surface of the tube or rod. The tube or rod is held securely by the lock-down means which, in turn, compresses and holds in place the FRP sheet against the surface of the structural member.

24 Claims, 14 Drawing Sheets

ANCHORAGE SYSTEM FOR STRUCTURAL REINFORCEMENT OF FIBER REINFORCED PLASTIC MATERIALS AND THE LIKE

FIELD OF THE INVENTION

The invention relates to an anchorage system for holding down structural reinforcing sheet, plate or shell made of fiber reinforced plastic (FRP) or steel or other metallic or non-metallic materials which are bonded to the surface of structural cements by means of the inherent concentric centering capability in the load transfer mechanism of the system.

BACKGROUND FOR THE INVENTION

Structural members, such as walls or columns, in buildings or bridges or other structural systems are often required to resist uplifting tensile forces and bending moments resulting from overturning actions caused by loads imposed on the structure due to its occupancy or external environmental actions, especially from the lateral loads of strong wind and earthquakes.

There is a large inventory of old structures in Canada and US and around the world which require repair or strengthening, rehabilitation or retrofit to restore or enhance their load carrying capacities to required performance level in order to ensure their safe use and operation. Enhancement of the tensile load or bending moment resistant capacities of individual structural members, and/or the restoration of deteriorated or damaged structural members to their pre-damaged capacities, are important parts of this process.

A practical means to enhance or restore the tensile load or bending moment capacity of a structural member is by adding external surfaced bonded reinforcing materials to the structural member. Thin steel plate or sheet has been used for this purpose. Recently since the 1990s, fiber reinforced plastic (FRP) sheets have been shown to be an attractive alternative to the steel plate. The FRP alternatives, which typically are of the types of carbon fiber reinforced plastic (FRP), glass fiber reinforced plastic (GFRP), aramid fiber reinforced plastic (AFRP), which is also commonly known by the trade name Kevlar, have the advantages of high strength, lightweight and excellent corrosion resistance compared to conventional reinforcing steel.

The conventional alternative FRP reinforcing system consists of bonding FRP sheets to the surface of the structural member by epoxy or other adhesives. The surface bonded FRP sheets provide additional tensile load resistance to the structural member in the direction parallel to its fiber direction. At the boundaries of the structural member to its supporting member or foundation, the load carried by the FRP sheets must be transferred to the supporting member or foundation. An anchorage system is critical for this load transfer and the effectiveness of the FRP strengthening system.

Previously, the anchorage system has an L-shaped angle anchor with one leg parallel to the FRP reinforced structural member and another leg parallel to the surface of the supporting element. The FRP sheet wrapping around the outer surfaces of the two legs of the angle is pressed against the surfaces of the structural member and the supporting element by the angle, which is in turn locked down to the supporting element by anchor bolts drilled through the surface of one leg of the angle (see FIG. 1). Because of the eccentricity between the loading direction of the FRP sheet and the hold down of the angle to the supporting member, there is significant bending or prying action to the angle shape resulting in large out-of-plane distortion of the FRP sheet from its loading plane. This leads to a reduced load carrying capacity and resistance by the FRP sheet, especially under cyclic load applications when the FRP sheet is repeatedly subjected to loading and unloading causing break or cut to the fiber due to the repeated cycles of out-of-plane deformations and warping. The premature failure of the FRP reinforcing system is due to the eccentricity between the load carried by the FRP sheet and the lock-down resistance from the angle anchorage system.

Another challenge when using FRP for structural reinforcement is the problem of debonding of the FRP sheet from the supporting member or foundation. Nanni et at. (A. Nanni, Khalifa, A., T. Alkhrdaji and S. Lansbury, "Anchorage of Surface Mounted FRP Reinforcement", *Concrete International: Design and Construction,* Vol. 21, No. 10, October 1999, pp. 49–54) attempted to employ a U-shaped anchor to prevent such debonding in beams reinforced with FRP sheets. In Nanni et al., a U-anchor is embedded at a bent portion of the end of the FRP reinforcement sheet into a preformed groove in the supporting member or foundation (see FIG. 2). The goal is to develop anchorage force in the U-anchor by embedment of the FRP sheet. Viscous paste is used to fill the groove. Optionally, the end portion of the FRP sheet may wrap around a FRP bar inside the groove. However, it is apparent that the FRP bar has no bearing on the exertion of anchorage force. Furthermore, the viscous paste may not be strong enough to hold the FRP sheet inside the groove.

Furthermore, in Nanni et al., the working principle of the U-anchor system is that the load transfer from the FRP sheet to the concrete base is highly dependent on the shear and tensile strength of the bond between the FRP sheet and the concrete on the inside surface of the groove. The U-anchor arrangement is just a means to increase the length of this bond area available for the transfer of the load, eccentricity still exists between the tensile force carried by the FRP sheet on the vertical web of the beam and the resultant anchor resistance provided by the bond between the FRP sheet and the concrete distributed over the circular inside surface of the groove.

Accordingly, there is a need for an improved anchoring system whereby the system is able to provide an inherent concentric centering capability in the load transfer mechanism and to eliminate the undesirable prying action effect. The present invention is for a new self-centering anchorage system which eliminates the eccentricity problem and allows the FRP material to fully utilize its high strength without premature failure.

SUMMARY OF THE INVENTION

It is an object of the present invention to provide an anchorage system which devoids the eccentricity problem in transferring the load carried by the surface reinforcing agent from the structural member to the supporting member whereby external hold-down force against the surface reinforcing agent is provided by an anchor rod or tube acting through the anchor rod or tube. According to one aspect of the invention, it provides an anchorage system for structural reinforcement comprising: (a) a structural member and a supporting member juxtaposing one another, whereby inside corner surfaces of the members are bonded with surface reinforcing agent made of structural reinforcing material; (b) a cylindrical anchoring means contiguously abutting the inside corner of the bonded surfaces of the structural member and supporting member; and (c) a lock-down means provided along the longitudinal axis of the anchoring means for mountably compressing the anchoring means against the bonded surfaces.

It is another object of the invention to provide an anchorage mechanism with easy installation without the need to employ new or advanced technology to manufacture or use. It is a further object of the invention to enable application of the anchorage mechanism to a variety of structures of different materials and shapes, such as reinforced concrete or masonry structures, structural members with a flat surface, such as straight walls and square columns, and structural members with a curved surface, such as curved walls and circular columns.

The surface reinforcement agents suitable for the anchorage system of the present invention can be selected from FRP sheets, plates and shells and other similar purpose metallic or non-metallic materials, including FRP composite materials.

DETAILED DESCRIPTION OF THE PREFERRED EMBODIMENT

The present invention is applicable to surface reinforcing agent made of conventional structural reinforcing materials. Preferably, the surface reinforcing agent is a surface reinforcing sheet, surface reinforcing plate or surface reinforcing shell. Also preferably, the structural reinforcing material is made of non-metal or metal. More preferably, structural reinforcing material is made of fiber reinforced plastic (FRP).

In a typical wall strengthening application, as is the case with the present invention, it may not be necessary to reinforce the supporting member, such as the foundation of a building structure. The surface bonded reinforcement agent, such as FRP sheet, may then only be required for the structural member, which is usually the non-horizontal structure (in most case, the vertical structure). Accordingly, for the purpose of seismic strengthening, continuous FRP sheets are not usually bonded to the supporting structures.

The preferred embodiment of the present invention teaches an anchorage system wherein load transferred from the FRP sheet is applied tangentially to the circular surface of the anchor tube or rod, whereas the hold down force exerted by the lock-down means of the anchorage system is applied concentrically through the center of the tube or rod, thus resulting in always maintaining a self centering eccentric arrangement in the load transfer mechanism.

Figure 1:
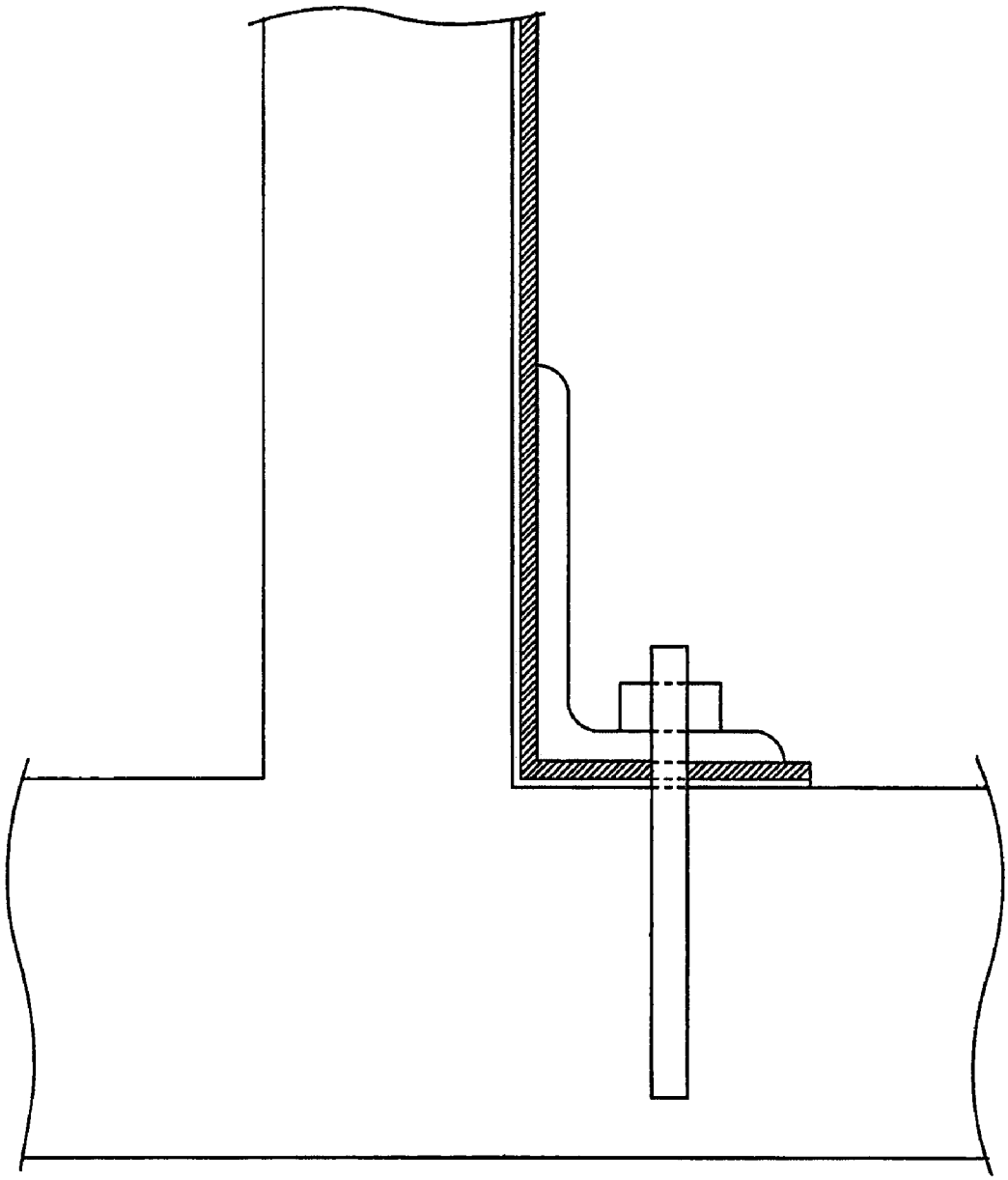
Figure 1 (Prior Art)
FIG. 1 shows a L-shaped angle anchor in the prior art.
Figure 2:
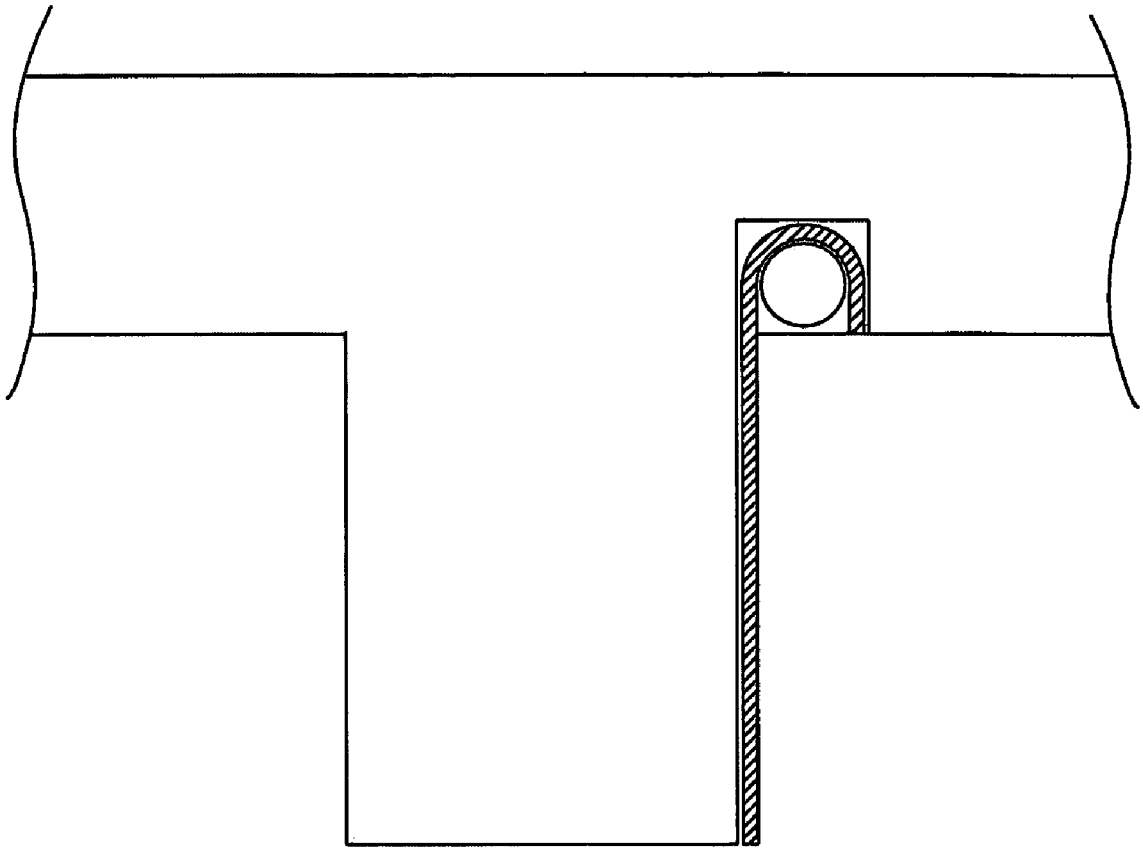
Figure 2 (Prior Art)
FIG. 2 shows an U-shaped anchor embedded within a preformed groove of a structural member in the prior art.
Figure 3A:
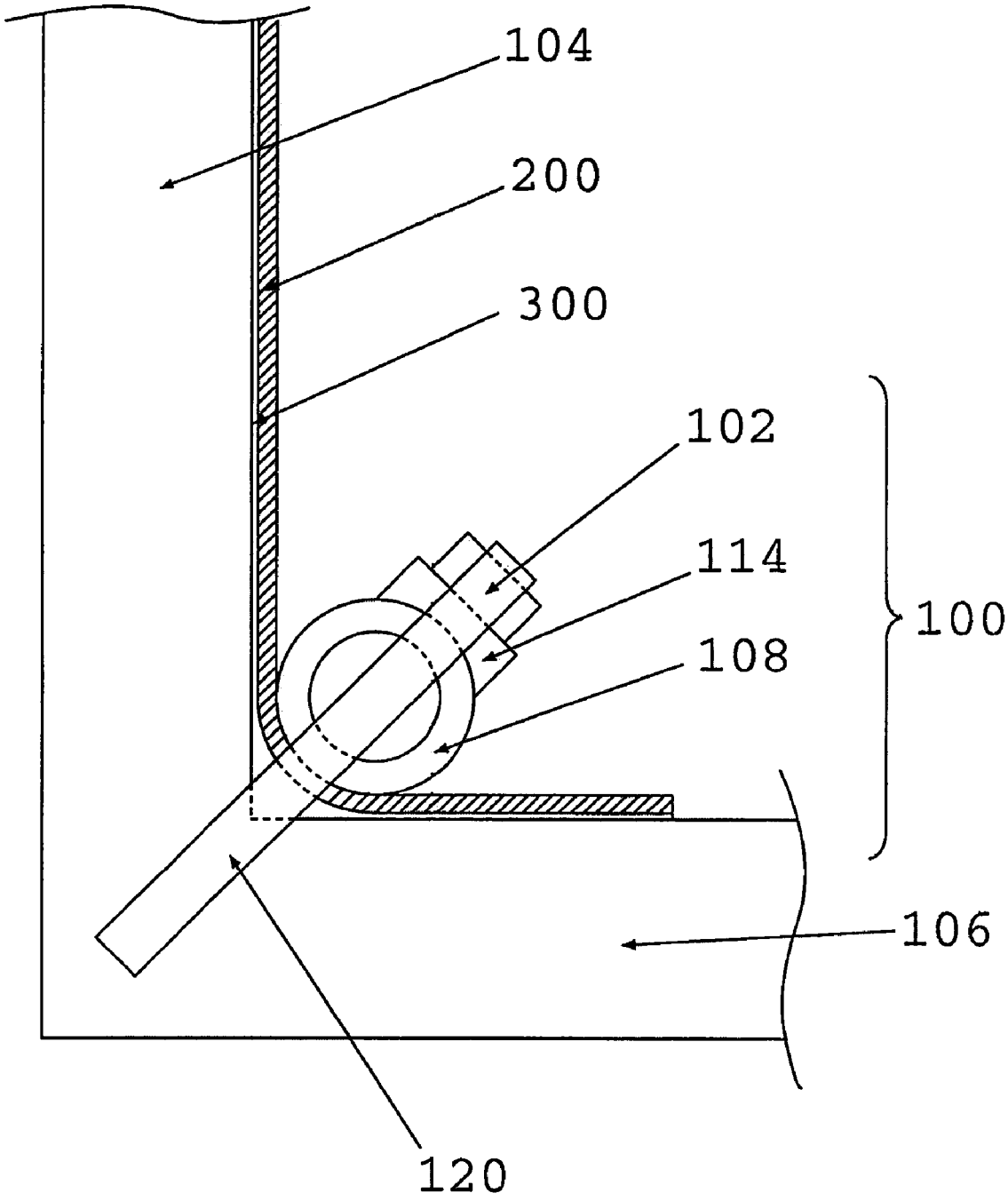
FIG. 3A is a cross-sectional side view of the anchorage system of the present invention showing a lock-down means holding down an anchor tube together with sections of the FRP sheet bonded to the reinforced structural member and supporting member.
Figure 3B:
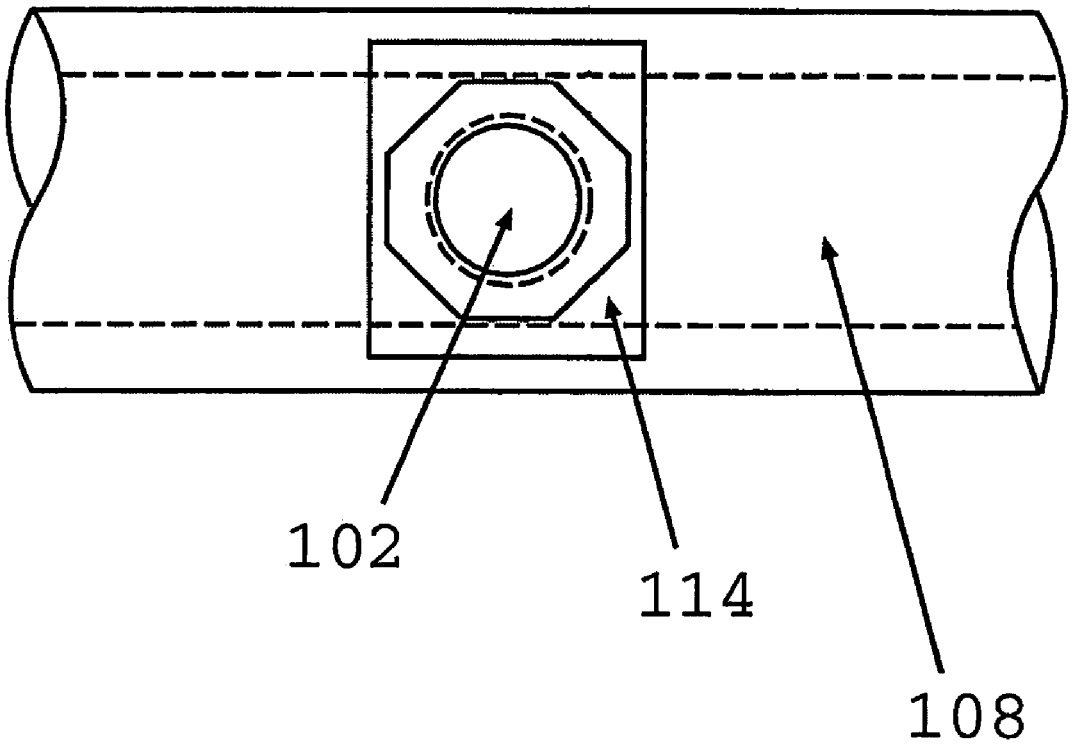
FIG. 3B is a top view of an anchor tube with the lock-down means mounted thereon through a curved sleeve block.

Referring now to FIGS. 3A and 3B, an anchorage system 100 for structural reinforcement of FRP sheet 200 is constructed by passing FRP sheet 200 around the outer circular surface of an anchor tube 108, thus transferring the load carried by the FRP sheet 200 to the anchorage system 100 always in the tangential direction of the anchor tube 108. As illustrated in FIG. 3A, the structural member and the supporting member are perpendicular to one anther, i.e., at 90°. However, as discussed later in the present disclosure, application of the present invention is not limited to this specific structural orientation.

The FRP sheet 200 is bonded by epoxy 300 or any other conventional bonding materials to the surface of the strengthening structural member 104 (shown vertical in FIG. 3A) and to the surface of the supporting member 106 (shown horizontal in FIG. 3A). Typically, structural member 104 is a concrete wall while supporting member 106 is a concrete foundation. Upon applying tensile load 400 to the FRP sheet 200, the resultant action of the applied FRP load and the interface shear force provided by the epoxy bond of the FRP sheet 200 to structural member 104 and supporting member 106 is perpendicular to the anchor tube 108 through its center in a direction equally subdividing between the structural member surface and the supporting member surface. In other words, anchor tube 108 acts as a pulley and the tension stresses carried by the FRP sheet 200 attached to the vertical part of structural member 104 equal the tension in the horizontal part of the FRP sheet, which is then transferred through the interface to the epoxy bonded concrete surface of footing along supporting member 106. The resultant action is to pull out the anchor tube 108 in that direction, i.e., away from the FRP sheet 200, at 45° which is the direction of the resultant of the two FRP sheet forces on the structural member and the supporting member.

Figure 5:
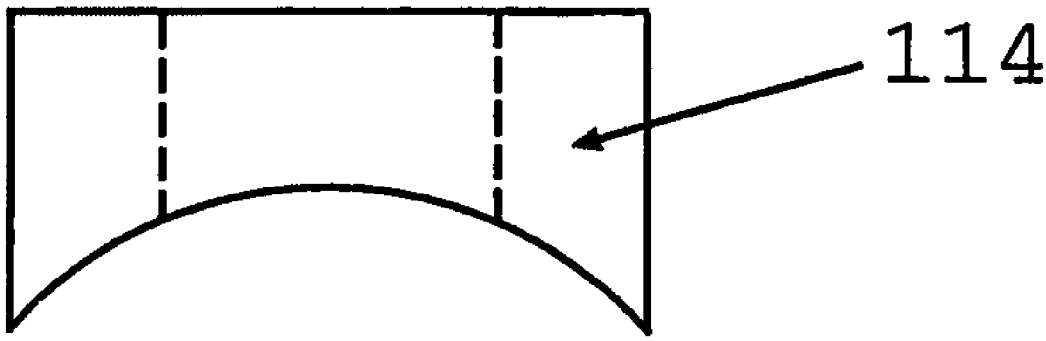
FIG. 5 is a side view of a curved sleeve block.

To resist the tendency of this pull out, a lock-down means 102 is securely mounted at a 45° angle (i.e. in the direction of the resultant of the two FRP sheet forces, typically bisecting the angle between the surface of the strengthening structural member 104 and the surface of the supporting member 106) on anchor tube 108 through pre-drilled hole 108' to provide an anchoring force through the tube center. The anchoring force is applied in a direction exactly opposite to the pull out force. As shown in FIG. 3A, the lock-down means 102 is an anchor bolt 120. Optionally, the anchoring force is applied by the lock-down means 102 through a curved sleeve block 114 (see FIG. 5) onto the anchor tube 108.

In the event that the structural member and the supporting member are not perpendicular to one another, then the resultant action to pulling out the anchor tube 108 is at an angle of the resultant of the two FRP sheet forces, typically bisecting the angle between the two bonded surfaces of the structural member and supporting member. As a corollary, the lock-down means 102 should be mounted on anchor tube 108 at this bisecting angle.

EXAMPLE

The anchor system of the present invention can be illustrated with the following strengthening wall example.

The design load of the anchor system is the load that the FRP sheet applies to the anchor tube in a wall specimen loaded at the top by a lateral force. The dimensions of the anchor tube are selected so that the maximum stress in the anchor tube under the design load does not exceed the yield stress of the anchor tube material. Using deep beam theory to determine the vertical tensile force distribution at the base of a flat rectangular wall panel loaded by a lateral force applied at the top, the vertical tensile force is found to be maximum at the end edge of the wall, and it reduces in magnitude towards the center of the wall width. This distributed vertical tensile load (line load) is applied on the surface of the anchor tube which is in contact with the FRP sheets. This load is only one part of the loads applied to the anchor tube. The second part is the load applied from the FRP sheet which extends horizontally on the footing surface which, due to the pulley effect, can be considered as equal to the load applied from the vertical FRP structural wall sheets. The resultant of these two components is the design load mentioned before. The maximum load carrying capacity of the strengthened wall with FRP sheets attached on each side of the wall can be determined from mechanics using the tensile material strength of the FRP sheets and the strength of the wall material.

In a concept feasibility and verification study of the anchor system of the present invention, a 3-inch external diameter steel mechanical pipe with a 0.5 inch wall thickness was chosen for the fabrication of the anchor tube in the anchor system for strengthening of a flat reinforced concrete rectangular shear wall of dimensions 100 mm thick×1500 mm wide×1795 mm high loaded by a 500 kN in-plane lateral force at the top. A curved sleeve block with its curving surface matching the curvature of anchor tube was fabricated from steel plate (3.5"×25."×1"). A hole of 1.5" diameter was drilled through the sleeve block and anchor tube for insertion of the lock-down means. The lock-down means in this example was an anchoring threaded rod with 1¼" diameter and 20" in length with flat washer and nut.

Figure 4:
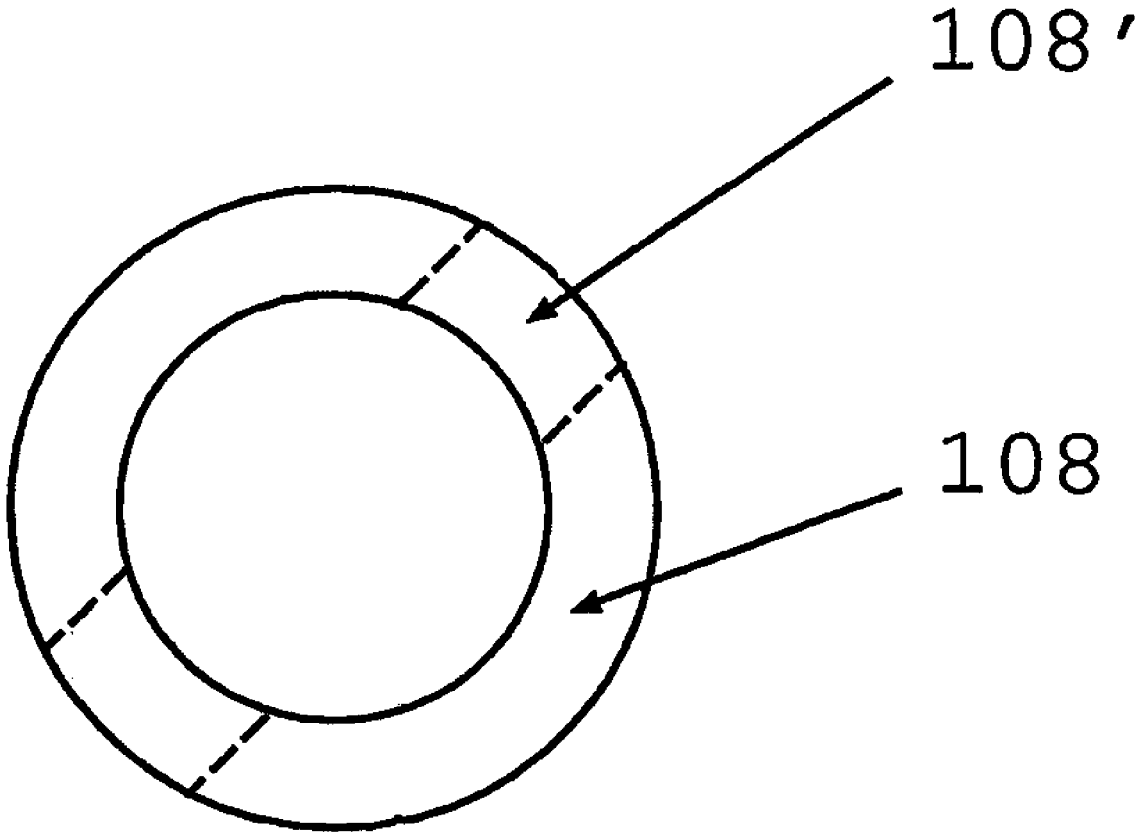
FIG. 4 is a cross-sectional view of the anchor tube used in the present invention.

FIG. 4 shows anchor tube 108 and the pre-drilled hole 108' for lock-down means 102 to pass therethrough. Suitable lock-down means 102 include chemical adhesive anchor, expansion anchor, anchor bolt, anchor strap threaded to washer and nut etc.

In the event that there is obstruction for the lock-down means 102 to penetrate the FRP bonded structure at an angle, another embodiment of the anchorage system of the present invention provides for an anchor strap 118 to hold down the anchor tube 108. In that case, a plurality of anchor strap 118 are projected into the strengthening structural member and the supporting member (see FIG. 7A), thereby securing the anchor tube 108 in place. Anchor strap 118 can be made of steel cable or steel rod, or cable or rod made of other suitable material.

Figure 7A:
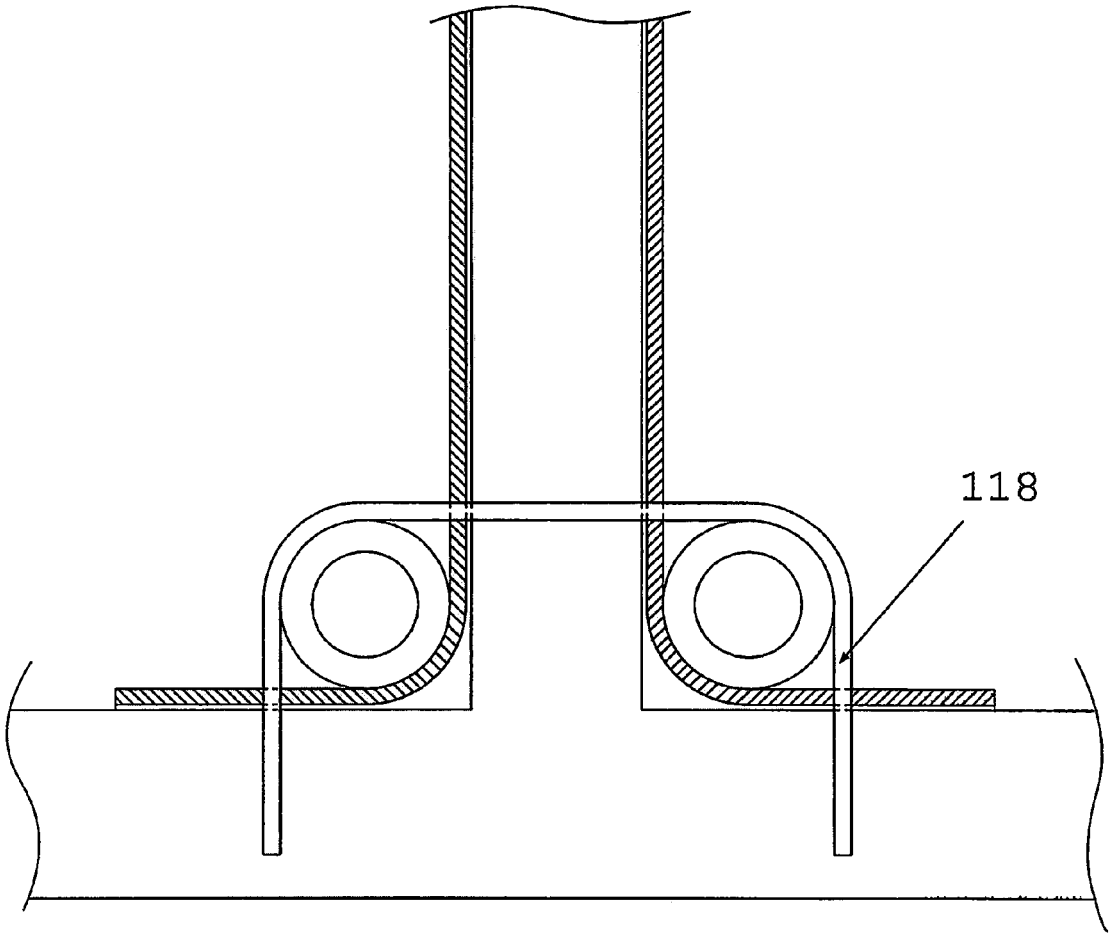
FIG. 7A is a cross-sectional side view of the anchorage system of the present invention showing a continuous anchor strap mounted inside the structural and supporting members together with sections of the FRP sheet bonded to the reinforced structural member and supporting member.
Figure 7B:
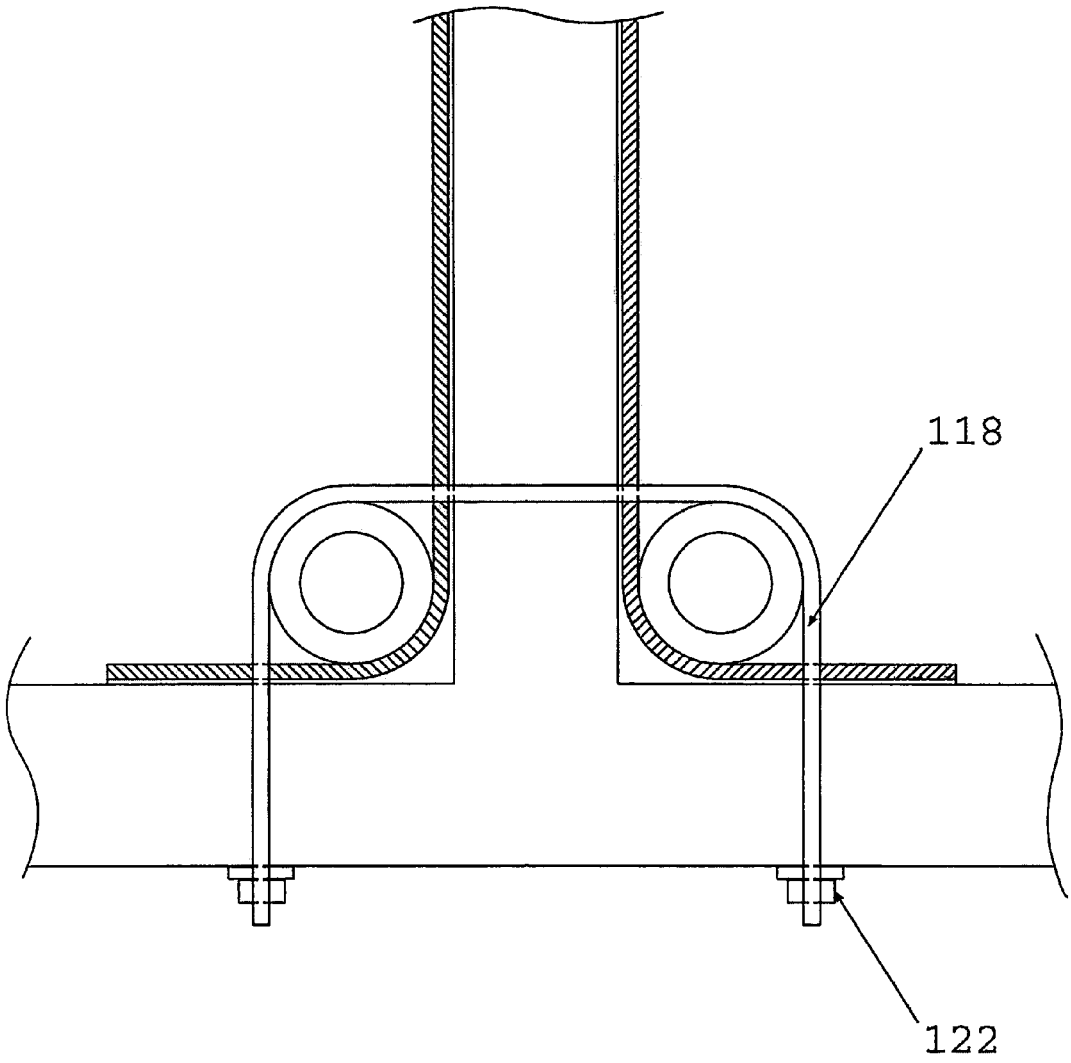
FIG. 7B is a cross-sectional side view of the anchorage system of the present invention showing a continuous anchor strap with the straps ends projecting through the supporting member and threadedly and securely mounted to the supporting member with washers and nuts.

Sometimes the supporting member may allow the anchor straps to project through the structure as shown in FIG. 7B. In FIG. 7B, a plurality of anchor strap 118 are projected through the supporting member and threadedly and securely mounted to the supporting member with washers and nuts 122.

While FIGS. 7A and 7B show FRP are surface bonded to both sides of the structural member, it should be noted that the double-sided bonding is desirable for strengthening a free standing wall. However, FRP surface double-sided bonding is unnecessary in most other cases.

Figure 6:
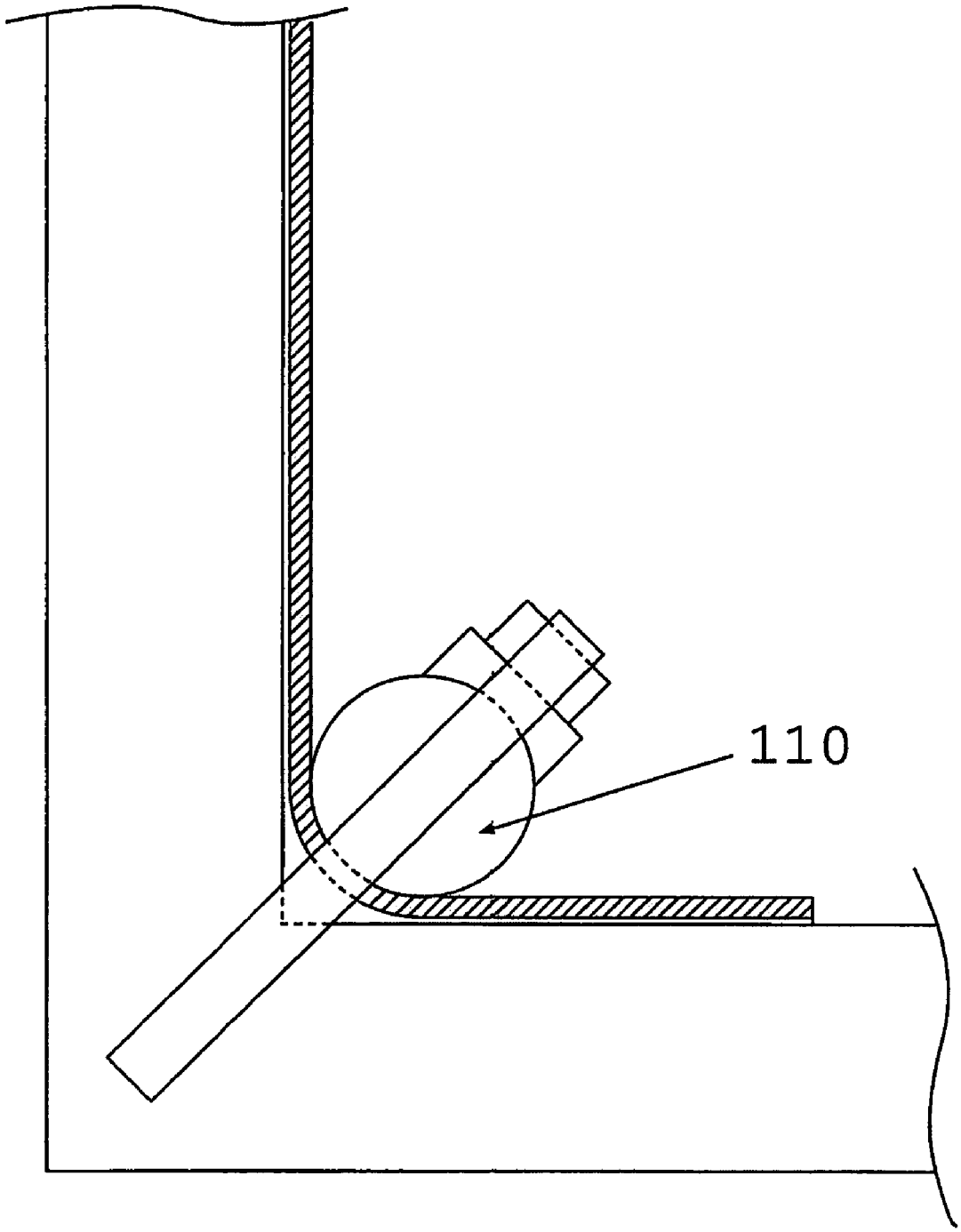
FIG. 6 is a cross-sectional side view of the anchorage system of the present invention showing a lock-down means holding down an anchor rod together with sections of the FRP sheet bonded to the reinforced structural member and supporting member.

In another embodiment of the anchorage system of the present invention, an anchor rod 110 is used to hold down or wrap up the FRP sheet instead of an anchor tube 108 (see FIG. 6).

Figure 8:
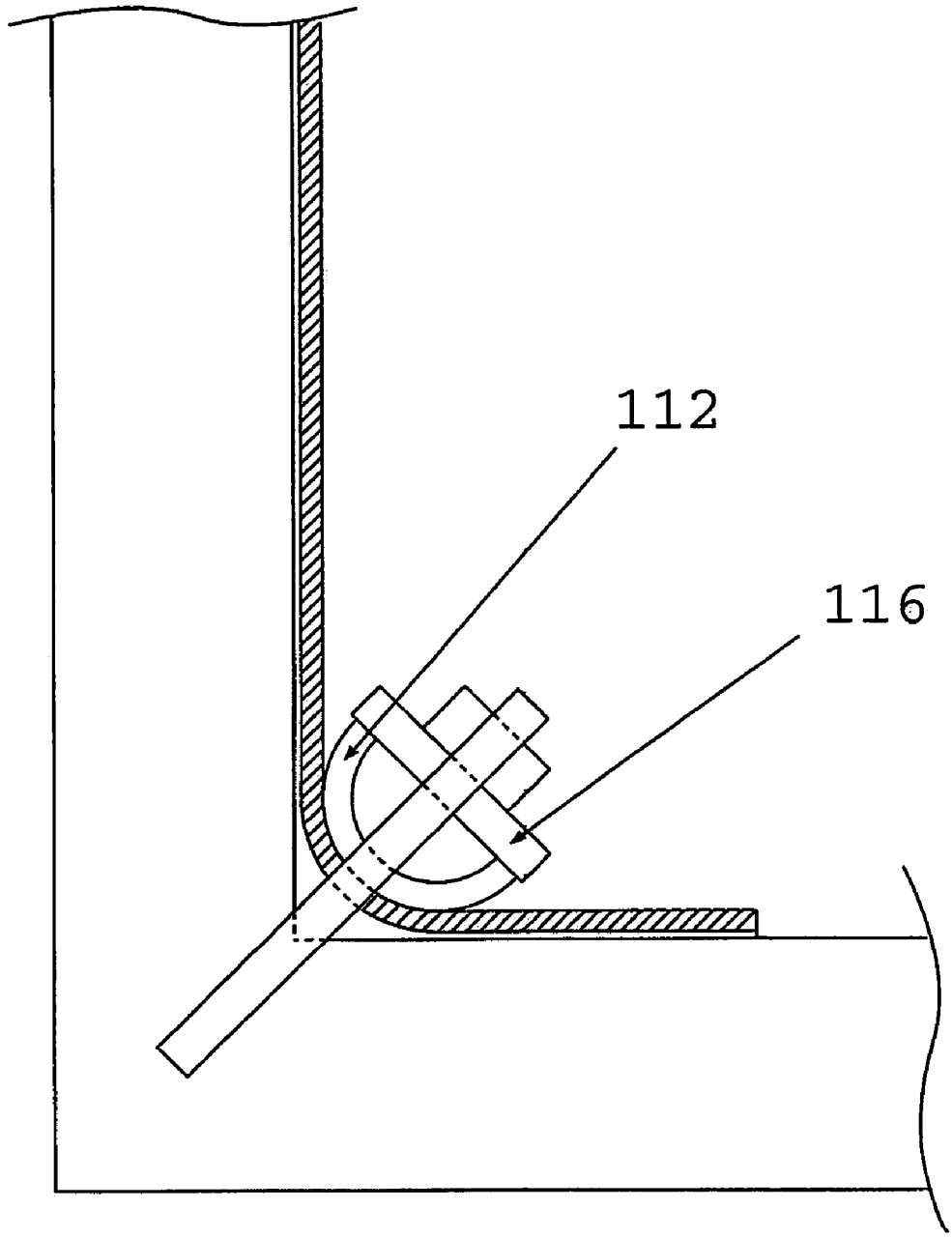
FIG. 8 is a cross-sectional side view of the anchorage system of the present invention showing a lock-down means holding down a half-circular anchor tube together with sections of the FRP sheet bonded to the reinforced structural member and supporting member.

Referring to FIG. 8, another embodiment of the anchorage system of the present invention uses a half-circular tube 112 or half circular rod (not shown). Since such a system applies the same pulley concept, the resultant action in pulling out the anchor tube away from the FRP sheet at 45°, the direction of the resultant of the two FRP sheet forces on the structural member and the supporting member which are perpendicular to one another, is the same. By employing a similar lock-down means mounted at a 45° angle onto the half-circular tube or rod, it provides the necessary anchoring force through the tube center.

As discussed earlier, for structural member and supporting member that are not perpendicular to one another, then the lock-down means 102 should be mounted on half-circular tube 112 at the angle bisecting the angle between the two bonded surfaces of the structural member and supporting member.

Figure 9:
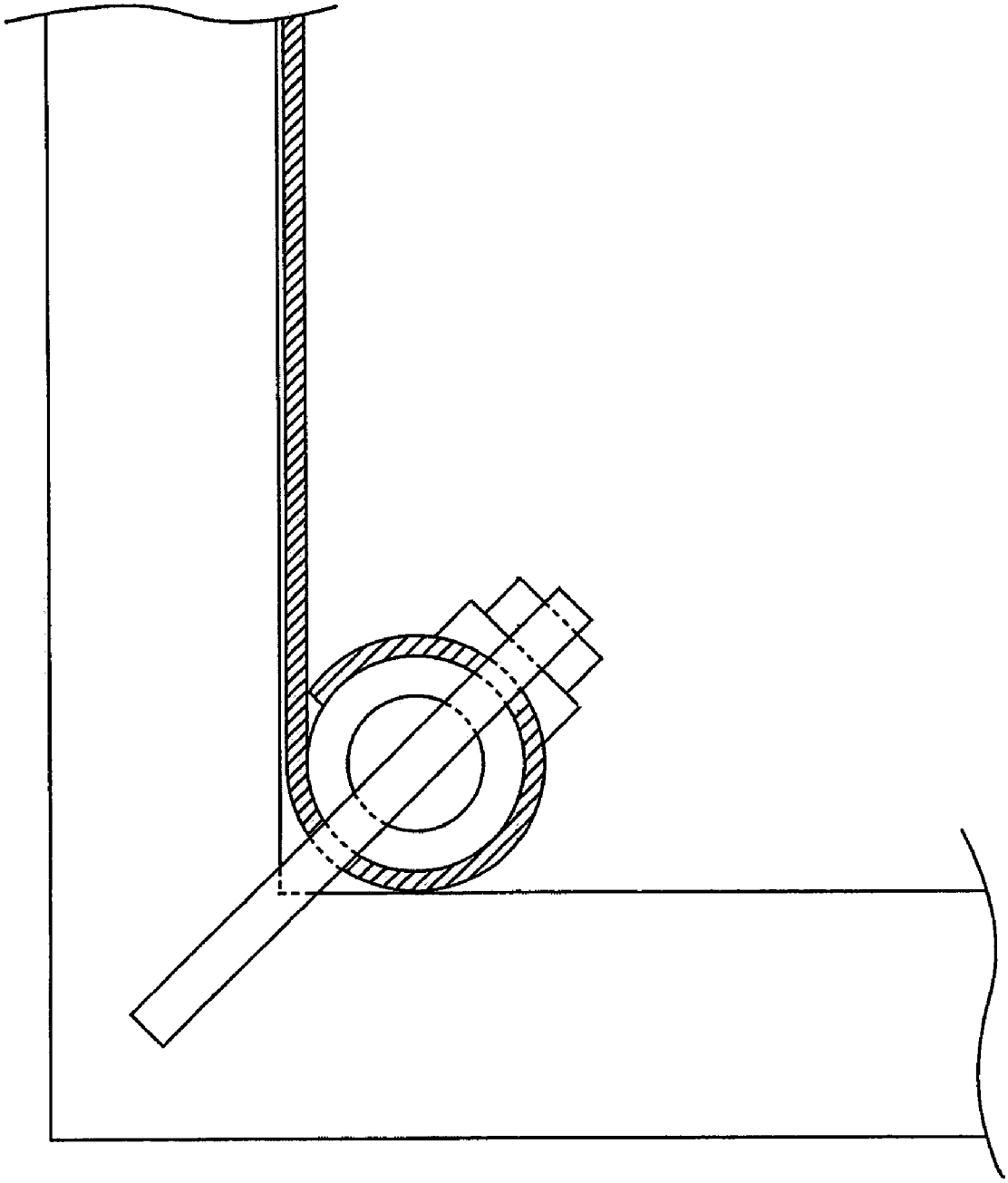
FIG. 9 is a cross-sectional side view of the anchorage system of the present invention showing a lock-down means holding down an anchor tube with one end of the FRP sheet wrapped around thereon and with sections of the FRP sheet bonded to the reinforced structural member.

FIG. 9 teaches another embodiment of the anchor system of the present invention. It shows a cross-sectional side view of an anchorage system with a lock-down means holding down an anchor tube with one end of the FRP sheet wrapped around thereon and with the remaining sections of the FRP sheet bonded to the reinforced structural member. This modified system is particular advantageous when supporting member, such as a concrete foundation, does not have sufficient clearance surface for continuous FRP bonding, or the FRP sheet is of limited dimension and the end of the sheet ends near the anchor tube.

Figure 10:
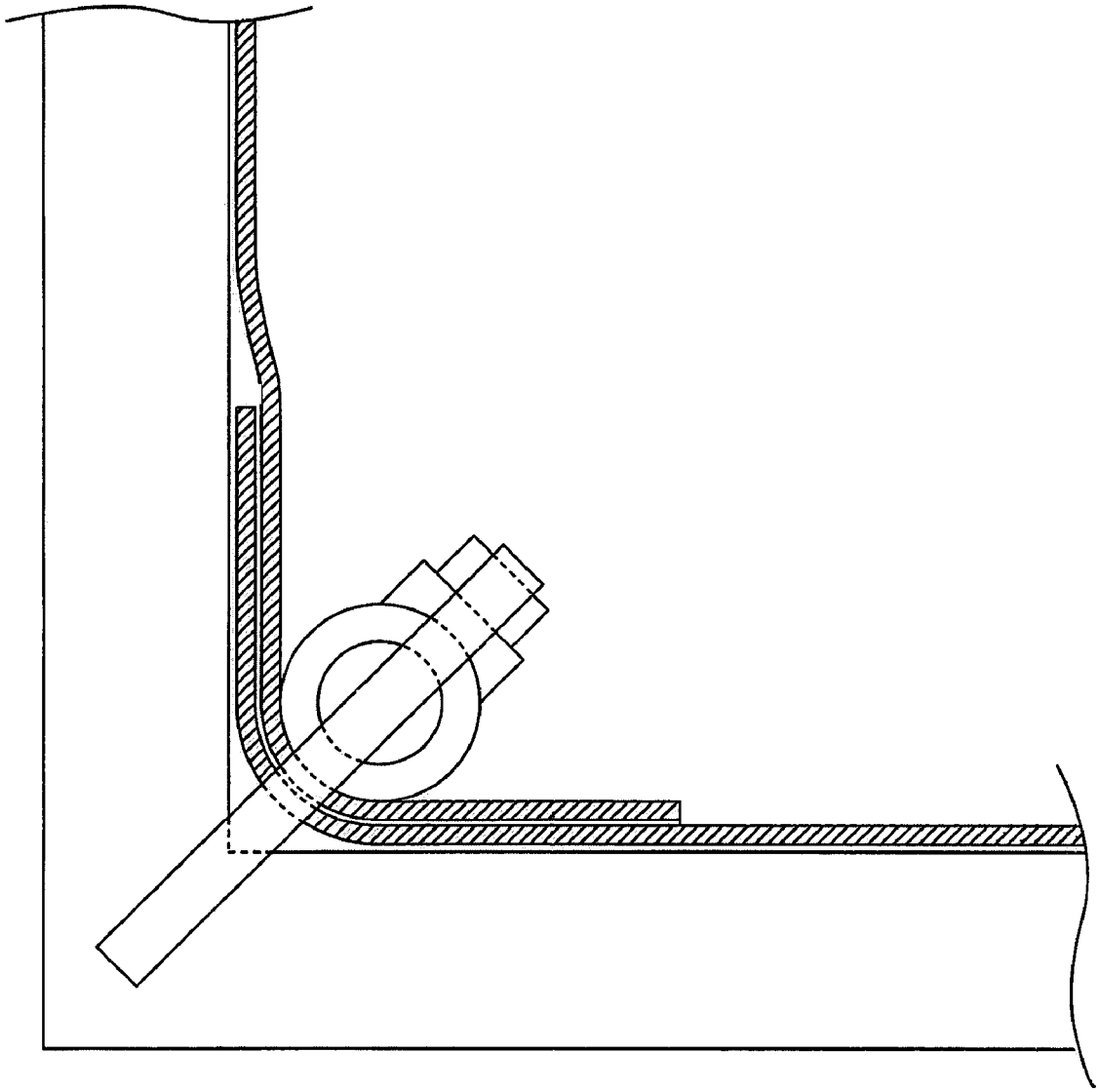
FIG. 10 is a cross-sectional side view of the anchorage system of the present invention showing a lock-down means holding down an anchor tube against two discontinued FRP sheets overlapping at their ends.
Figure 11:
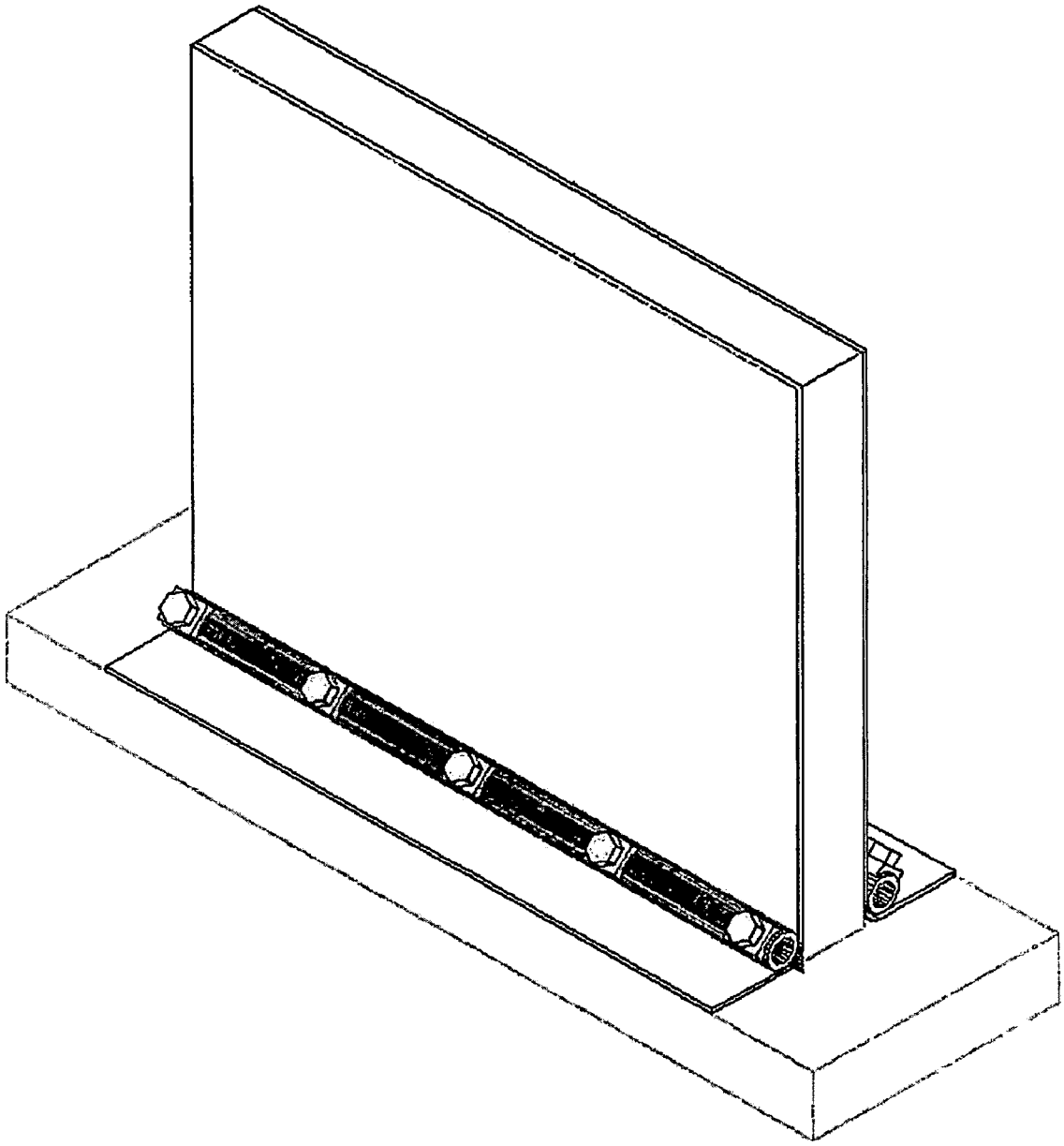
FIG. 11 is a perspective view of the anchorage system of the present invention with FRP sheets bonded to a flat wall.

In another embodiment as shown in FIG. 10, the anchor system of the present invention can be used to enhance the strength and performance of an overlapping joint of the free end portions of the two separate FRP sheets. In such a case, the anchor tube can accommodate the first free end portion of one FRP sheet bonded to the structural member, and the second free end portion of another FRP sheet bonded to the supporting member. This results in continuing the FRP sheet bonding of two free end portions of FRP sheets.

While the anchorage system of the present invention is applicable for FRP sheets bonded to flat surfaces (see FIG.

Figure 12:
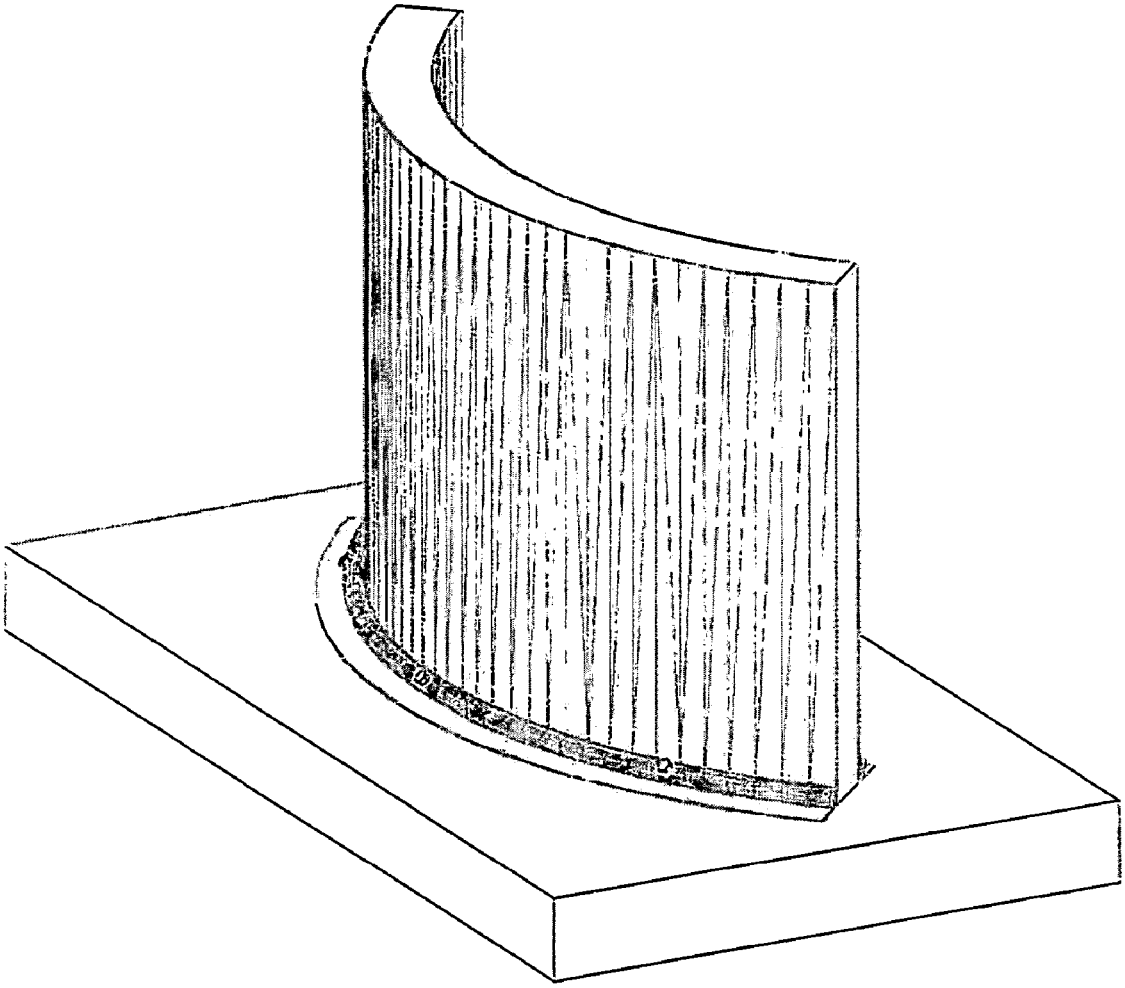
FIG. 12 is a perspective view of the anchorage system of the present invention with FRP sheets bonded to a curved wall.

11), due to its unique design, it can be advantageously applied to curved surfaces, such as circular columns or curved wall structures. In the case of curved walls, such as the one shown in FIG. 12, a flexible or bent anchor tube is placed along the curvature of the two walls and held down by the lock-down means at suitable spaced apart intervals. Depending on the dimension of the walls and degree of the curvature, the anchor tube can be made of materials with flexural strength to capacitate necessary bending of the tube.

Application of the anchorage system of the present invention is not limited to anchorage application of bonded FRP sheet. The structural and/or supporting surfaces can be reinforced with bonded or unbonded reinforcing plate or shell made of FRP or steel or other metallic or non-metallic materials.

It can be readily observed that the anchorage system of the present invention is applicable for rehabilitating existing structures as well as for building new structures.

It is clear that the inventive concept of this anchorage system is not limited to retrofitting or repairing of existing structures, such as seismic upgrade of structural and supporting walls. Any new building structures can incorporate the present inventive concept and provide for improved structural reinforcements. Thus, the embodiments depicted herein are intended to be merely illustrative and not restrictive in any sense.

It is further understood that the present invention may be carried out in other specific way than those herein set forth without departing from the spirit and essential characteristics of such invention. The present embodiments are, therefore, to be considered in all respects as illustrative and not restrictive, and all changes coming within the meaning and equivalency range of the appended claims are intended to be embraced therein.

What is claimed is:

1. An anchorage system for structural reinforcement comprising:

(a) a structural member and a supporting member juxtaposing one another, whereby inside corner surfaces of said members are bonded with surface reinforcing agent made of structural reinforcing material;

(b) a cylindrical anchoring means contiguously abutting the inside corner of the bonded surfaces of said structural member and supporting member; and (c) a lock-down means provided along the longitudinal axis of said anchoring means for mountably compressing said anchoring means against said bonded surfaces.

2. The anchorage system of claim 1, wherein said surface reinforcing agent is a surface reinforcing sheet, surface reinforcing plate or surface reinforcing shell.

3. The anchorage system of claim 1, wherein said structural reinforcing material is made of non-metal or metal.

4. The anchorage system of claim 1, wherein said structural reinforcing material is fiber reinforced plastic (FRP) or steel.

5. The anchorage system of claim 1, wherein said cylindrical anchoring means is an anchor tube or anchor rod.

6. The anchorage system of claim 1, wherein said cylindrical anchoring means is a half-circular anchor tube or rod, such that the circular edge of said tube or rod abuts the bonded surfaces of said structural member and supporting member.

7. The anchorage system of claim 1, wherein said structural member and said supporting member are perpendicular to one another.

8. The anchorage system of claim 7, wherein said lock-down means mountably compresses said anchoring means against said bonded surfaces with a plurality of anchor bolts passing said anchoring means therethrough at 45°.

9. The anchorage system of claim 1, wherein said structural member and said supporting member are not perpendicular to one another.

10. The anchorage system of claim 9, wherein said lock-down means mountably compresses said anchoring means against said bonded surfaces with a plurality of anchor bolts passing said anchoring means therethrough at an angle bisecting the angle between the said bonded surfaces of the structural member and supporting member.

11. The anchorage system of claim 1, wherein said lock-down means is mountably compressing said anchoring means against said bonded surfaces with a plurality of anchor straps.

12. An anchorage system for structural reinforcement comprising:

(a) a supporting member;

(b) a structural member juxtaposing with said supporting member, whereby inside corner surface of said structural member is bonded with surface reinforcing agent made of structural reinforcing material, with a free end portion of said structural reinforcing materials exposed near the inside corner surface of the structural member;

(c) a cylindrical anchoring means contiguously abutting the inside corner of the supporting member and the bonded surface of said structural member, wherein said free end portion of said surface reinforcing agent is wrapped around said anchoring means thereon;

(d) a lock-down means provided along the longitudinal axis of said anchoring means for mountably compressing said anchoring means against said bonded surfaces.

13. The anchorage system of claim 12, wherein said surface reinforcing agent is a surface reinforcing sheet, surface reinforcing plate or surface reinforcing shell.

14. The anchorage system of claim 12, wherein said structural reinforcing material is made of non-metal or metal.

15. The anchorage system of claim 12, wherein said structural reinforcing materials is fiber reinforced plastic (FRP) or steel.

16. The anchorage system of claim 12, wherein said cylindrical anchoring means is an anchor tube or anchor rod.

17. The anchorage system of claim 12, wherein said cylindrical anchoring means is a half-circular anchor tube or rod, such that the circular edge of said tube or rod abuts the bonded surfaces of said structural member and supporting member.

18. The anchorage system of claim 12, wherein said structural member and said supporting member are perpendicular to one another.

19. The anchorage system of claim 18, wherein said lock-down means mountably compresses said anchoring means against said bonded surfaces with a plurality of anchor bolts passing said anchoring means therethrough at 45°.

20. The anchorage system of claim 12, wherein said structural member and said supporting member are not perpendicular to one another.

21. The anchorage system of claim 20, wherein said lock-down means mountably compresses said anchoring means against said bonded surfaces with a plurality of anchor bolts passing said anchoring means therethrough at an angle bisecting the angle between the said bonded surfaces of the structural member and supporting member.

22. The anchorage system of claim 12, wherein said lock-down means mountably compresses said anchoring means against said bonded structural surface and said unbonded supporting surface with a plurality of anchor straps.

23. An anchorage system for structural reinforcement comprising:

(a) a curved structural member and a curved supporting member juxtaposing one another, whereby inside corner surfaces of said members are bonded with surface reinforcing agent made of structural reinforcing material;

(b) a flexible or bent cylindrical anchoring means contiguously abutting the inside corner of the bonded curved surfaces of said structural member and supporting member; and (c) a lock-down means provided along the longitudinal axis of said anchoring means for mountably compressing said anchoring means against said bonded surfaces.

24. An anchorage system for structural reinforcement comprising:

(a) a structural member and a supporting member juxtaposing one another, whereby inside corner surface of said structural member is bonded with surface reinforcing agent made of structural reinforcing material, with a first free end portion of said structural reinforcing materials exposed near the inside corner surface of the structural member, and said supporting member is bonded with surface reinforcing agent made of structural reinforcing material, with a second free end portion of said structural reinforcing materials exposed near the inside corner surface of the supporting member, such that said first and second free ends overlapping one another;

(b) a cylindrical anchoring means contiguously abutting the inside corner of the surfaces of said structural member and supporting member bonded by said two free end portions of said structural reinforcing materials; and (c) a lock-down means provided along the longitudinal axis of said anchoring means for mountably compressing said anchoring means against said bonded surfaces.

* * * * *